US007344367B2

(12) United States Patent
Manole

(10) Patent No.: US 7,344,367 B2
(45) Date of Patent: Mar. 18, 2008

(54) ROTARY COMPRESSOR HAVING A DISCHARGE VALVE

(75) Inventor: Dan M. Manole, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 11/328,868

(22) Filed: Jan. 10, 2006

(65) Prior Publication Data

US 2006/0159570 A1 Jul. 20, 2006

Related U.S. Application Data

(60) Provisional application No. 60/644,653, filed on Jan. 18, 2005.

(51) Int. Cl.
*F03C 2/00* (2006.01)
*F04C 18/00* (2006.01)

(52) U.S. Cl. ..... 418/173; 418/177; 418/270; 417/356; 137/539; 137/540

(58) Field of Classification Search ..... 418/172, 418/173, 177, 270, DIG. 1; 417/356, 902; 137/540, 539, 543.15, 543.17
See application file for complete search history.

(56) References Cited

U.S. PATENT DOCUMENTS

| | | | | |
|---|---|---|---|---|
| 1,882,220 | A | 10/1932 | Kercher | |
| 1,964,415 | A | 6/1934 | Van Deventer | |
| 2,122,462 | A | 7/1938 | Fricke | |
| 2,143,399 | A | 1/1939 | Abercrombie | |
| 2,162,639 | A * | 6/1939 | Pontis et al. | 417/356 |
| 2,324,434 | A | 4/1943 | Shore | |
| 2,415,011 | A | 1/1947 | Hubacker | |
| 2,420,124 | A | 5/1947 | Coulson | |
| 2,440,593 | A * | 4/1948 | Miller | 418/173 |
| 2,898,032 | A | 8/1959 | Katzenberger | |
| 3,592,176 | A | 7/1971 | Feuse | |
| 3,697,203 | A | 10/1972 | Butler | |
| 3,845,784 | A | 11/1974 | Sullivan | |
| 4,172,465 | A | 10/1979 | Dashner | |
| 4,384,828 | A | 5/1983 | Rembold et al. | |

(Continued)

FOREIGN PATENT DOCUMENTS

| | | |
|---|---|---|
| JP | 1-253583 | 10/1989 |

(Continued)

OTHER PUBLICATIONS

Japanese patent together with English language abstract.

*Primary Examiner*—Theresa Trieu
(74) *Attorney, Agent, or Firm*—Baker & Daniels LLP

(57) ABSTRACT

A rotary compressor having a housing, a rotor positioned within the housing defining a compression chamber, the rotor rotatable about an axis of rotation, a discharge port in the rotor in fluid communication with the compression chamber, and a valve assembly mounted to the rotor to regulate the pressure of the fluid within the compression chamber. In one embodiment, the valve assembly is canted or obliquely aligned with respect to the axis of rotation of the rotor and a radial axis perpendicular to and intersecting the axis of rotation. Aligning the valve assembly in this way allows the displacement of the valve head of the valve assembly to be substantially collinear with forces acting on the valve head.

3 Claims, 9 Drawing Sheets

U.S. PATENT DOCUMENTS

| | | | | |
|---|---|---|---|---|
| 4,427,351 | A | 1/1984 | Sano | |
| 4,673,343 | A | 6/1987 | Moore | |
| 4,773,836 | A | 9/1988 | Moore | |
| 4,892,467 | A | 1/1990 | Crofoot | |
| 4,900,237 | A | 2/1990 | Reedy | |
| 4,958,991 | A | 9/1990 | Kikuchi | |
| 5,035,587 | A | 7/1991 | Collingborn | |
| 5,181,843 | A | 1/1993 | Hekman et al. | |
| 5,577,903 | A | 11/1996 | Yamamoto | |
| 5,580,231 | A | 12/1996 | Yasui | |
| 5,641,279 | A | 6/1997 | Yamamoto | |
| 5,733,112 | A | 3/1998 | Kang | |
| 6,024,548 | A | 2/2000 | Bushnell | |
| 6,068,022 | A | 5/2000 | Schultz et al. | |
| 6,077,058 | A | 6/2000 | Saitou et al. | |
| 6,152,718 | A | 11/2000 | Kobayashi | |
| 6,234,194 | B1 | 5/2001 | Jainek et al. | |
| 6,585,498 | B2 | 7/2003 | Arbogast et al. | |
| 6,616,428 | B2 | 9/2003 | Ebara et al. | |
| 6,769,267 | B2 | 8/2004 | Ebara et al. | |
| 6,881,041 | B2 * | 4/2005 | Lee | 418/177 |
| 2003/0115900 | A1 | 6/2003 | Matsumoto et al. | |
| 2004/0005234 | A1 * | 1/2004 | Dreiman et al. | 417/902 |
| 2005/0031465 | A1 * | 2/2005 | Dreiman et al. | 417/356 |
| 2005/0201884 | A1 | 9/2005 | Dreiman | |

FOREIGN PATENT DOCUMENTS

| | | | | |
|---|---|---|---|---|
| JP | 02009980 | A * | 1/1990 | 418/177 |

* cited by examiner

ROTARY COMPRESSOR HAVING A DISCHARGE VALVE

CROSS REFERENCE TO RELATED APPLICATION

This application claims the benefit under 35 U.S.C. §119 (e) of U.S. Provisional Patent Application Ser. No. 60/644,653, entitled ROTATING DISCHARGE VALVE, filed on Jan. 18, 2005, the entire disclosure of which is hereby expressly incorporated by reference herein.

BACKGROUND OF THE INVENTION

1. Field of the Invention

The present concept relates to rotary compressors. More particularly, the present concept relates to discharge valves for rotary compressors.

2. Description of the Related Art

A typical rotary compressor includes a housing, a stator positioned within the housing, and a rotor driven, i.e., rotated, by the stator, the rotor being mounted to a first end of a crankshaft. The compressor further includes a compression mechanism operably engaged with the opposite end of the crankshaft. The compression mechanism typically includes an eccentric member engaged with the crankshaft that is rotated within a stationary cylinder block to compress a working fluid, or refrigerant, in a compression chamber defined by the eccentric member and the stationary cylinder block. Commonly, a discharge valve is mounted to the stationary cylinder block to release pressurized refrigerant from the compression chamber.

In rotary compressors of the general type disclosed in the present application, unlike the typical compressors described above, the compressor includes a rotatable rotor that surrounds the eccentric member. Such compressors are illustrated and described in co-pending U.S. Published Application No. 2005/0201884 entitled COMPACT ROTARY COMPRESSOR WITH CARBON DIOXIDE AS WORKING FLUID, filed on Mar. 9, 2004. In these compressors, the refrigerant is drawn into a compression chamber defined by the rotor and the eccentric member and is compressed by the relative movement thereof. As the rotating rotor defines the compression chamber, these compressors do not have a stationary cylinder block and the discharge valve is typically mounted on the rotor.

A discharge valve typically includes a valve member that is yieldably positioned against a discharge port of the compression chamber to permit refrigerant to be drawn into the compression chamber and compressed therein. In some embodiments, the valve member, or valve head, is held in this position by a valve spring until sufficient fluid pressure has been generated within the compression chamber. Subsequently, the pressurized fluid lifts the valve head away from the discharge port allowing fluid to be discharged. After a quantity of working fluid has been discharged from the compression chamber, the fluid pressure inside the compression chamber decreases, the pressure force acting on the valve head decreases, and the valve spring repositions the valve head against the discharge port.

The discharge valve, in compressors of the general type disclosed in the present application, may be oriented such that the valve head, when it is displaced, is displaced in a generally radial manner with respect to the axis of rotation of the rotor. As a result of orienting the valve in this manner, the valve head, when the rotor is rotated, is biased radially outwardly towards its open position by an acceleration acting radially on the valve head. To compensate for this acceleration, the stiffness of the valve spring holding the valve head in place can be selected such that valve head remains seated until it is displaced by the fluid in the compression chamber once the fluid has reached a predetermined pressure level.

However, the valve head may also experience an acceleration, and force, tangential to the radial direction discussed above. This tangential force can be created by gas drag, changes in angular velocity of the rotor, or changes in radial position of the valve head. A tangential force created by a change in the radial position of the valve head occurs when the valve head is displaced from the valve seat to release pressurized refrigerant from the compression chamber, and also when the valve head is returned to the valve seat. This tangential force may cause the valve head to displace tangentially with respect to the desired radial path. In effect, the tangential force acting on the valve head may displace the valve head in a non-radial direction or along a curvilinear path, for example. As a result, the valve head may become misaligned with respect to the valve seat, thus allowing semi-compressed working fluid to escape through the compression chamber discharge port prematurely. What is needed is an improvement over the foregoing.

SUMMARY OF THE INVENTION

The present invention includes a valve assembly mounted to a rotor such that the movement of the valve head towards and away from the discharge port in the rotor is substantially linear during the operation of the compressor. To compensate for the tangential forces described above, in one embodiment, the path of the valve head displacement is canted or aligned obliquely with respect to the axis of rotation of the rotor. In this embodiment, the path of the valve head is aligned such that it is substantially co-linear with the resultant force vector applied to the valve head, where the resultant force vector comprises the combined force of the tangential and radial forces applied to the valve head. As a result, in operation, the valve head will lift away from and return to the valve seat along a substantially linear path of displacement, as opposed to being displaced along a substantially curvilinear or undesirable path, as described above. Accordingly, there is less opportunity for the valve head to be misaligned with respect to the valve seat. As discussed above, an improperly seated valve head may allow working fluid to escape the compression chamber insufficiently pressurized, thus rendering the compressor inoperable or inefficient. Further, a misaligned valve head may also cause the valve head to impact the valve seat with additional force and thus cause undesirable noise and/or premature wear of the valve head.

In other embodiments, an external guide may be provided to guide the valve head and thus limit the valve head's tangential movement. Further, a guide can be positioned internal to the valve head to likewise prevent tangential movement of the valve head.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken. in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention in any manner.

DETAILED DESCRIPTION OF THE INVENTION

Figure 1:
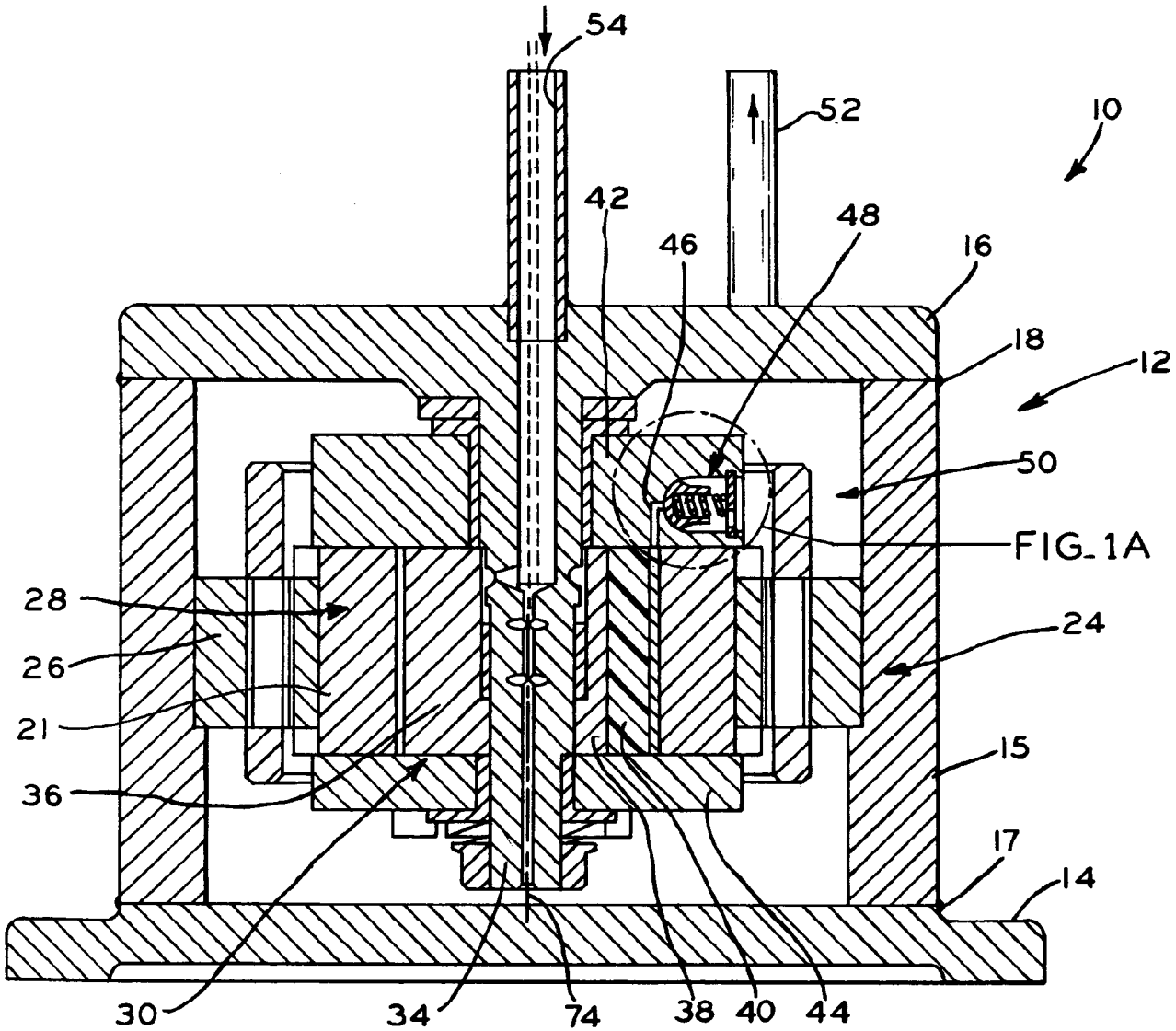
FIG. 1 is an elevational cross-sectional view of a rotary compressor in accordance with an embodiment of the present invention.

Referring to FIGS. 1-4, an exemplary rotary compressor 10 includes a hermetically sealed housing 12 including base 14, annular side wall 15 and top wall 16. Base 14 is hermetically sealed to wall 15 by welding, brazing, or the like at location 17. Similarly, side wall 15 is hermetically sealed to top wall 16 by welding, brazing, or the like at location 18. Compressor 10 includes electric motor 24 having stator 26 and rotor 28 which defines a portion of compression mechanism 30. Compression mechanism 30 compresses a refrigerant, such as carbon dioxide, for example, from a low pressure to a higher pressure for use in a refrigeration system, for example. Stator 26 is rigidly mounted within housing 12 and circumscribes rotor 28. Extending through rotor 28 is stationary shaft 34 which is, in this embodiment, integrally formed with top wall 16. During operation, stator 26 generates a rotating electromagnetic field to rotationally drive rotor 28, having permanent magnets 29 mounted in recesses 31, about an axis defined by shaft 34. Compressor 10 further includes oil in oil sump 13 which accumulates in oil sump 13 after precipitating from the refrigerant flowing through the compressor. Shaft 34 includes oil passages 11 which direct a flow of oil from the refrigerant to bearing surfaces between the relatively moving components of the compressor. Other exemplary rotary compressors are illustrated and described in U.S. Published Application No. 2005/0201884 entitled COMPACT ROTARY COMPRESSOR WITH CARBON DIOXIDE AS WORKING FLUID, filed on Mar. 9, 2004, the entire disclosure of which is hereby expressly incorporated by reference herein.

Rotor 28 includes annular section 21 and end plates 42 and 44 and holes 25 for receiving bolts 27 which fasten annular section 21 and end plates 42 and 44 together. As discussed below, rotor 28 also defines internal compression chamber 33. Referring to FIGS. 1-4, an eccentric portion 38 is integrally formed on shaft 34 and is located within the compression chamber defined by rotor 28. Compression mechanism 30 further includes roller 36 which is rotatably mounted on eccentric 38. Vane 40 extends radially inwardly within the compression chamber to engage roller 36. As illustrated in FIGS. 3 and 4, vane 40 has a first end positioned within slot 41 in roller 36 and a second end fixed within slot 39 of rotor 28. Vane 40, together with roller 36, divides the compression chamber into variable-volume, crescent-shaped suction and compression pockets. As vane 40 is mutually engaged with roller 36 and rotor 28, roller 36 is rotationally driven by rotor 28 through vane 40. However, the axis of rotation of roller 36 is offset, or eccentric, with respect to the axis of rotation of rotor 28. As a result, rotor 28 drives roller 36 in an orbiting motion about eccentric portion 38. This orbiting motion draws in and compresses pockets of refrigerant between rotor 28 and roller 36. To account for the eccentric movement of roller 36 with respect to rotor 28, vane 40 can slide within slot 41 of roller 36. In addition, as illustrated in FIGS. 3 and 4, vane 40 can assume a range of angular orientations with respect to roller 36. More particularly, roller 36 includes bushing 43, which defines slot 41, which is free to pivot within recess 45, thereby allowing vane 40, which is positioned in slot 41, to rotate relative to roller 36. Bushing 36 further includes elongate aperture 33 for receiving pin 35. The ends of pin 35 are fixed within rotor 28 and define an axis about which bushing 36 and vane 40 may rotate.

During operation, in the present embodiment, low pressure refrigerant is drawn into the compression chamber through longitudinal passage 54 in shaft 34. Once the refrigerant gas is compressed to a higher pressure within the compression chamber, the compressed refrigerant is discharged through a discharge passage 46 (FIG. 1) and a discharge valve, such as discharge valve 48, for example, into an interior chamber 50 of housing 12. Thereafter, the compressed refrigerant exits interior chamber 50 through outlet 52. Compressor 10, in the present embodiment, is a high side compressor, however, the present invention is not so limited. Further, in the present embodiment, the compression chamber is located internal to the rotor. In other embodiments, the rotor may be on the outside of the rotor.

Figure 1A:
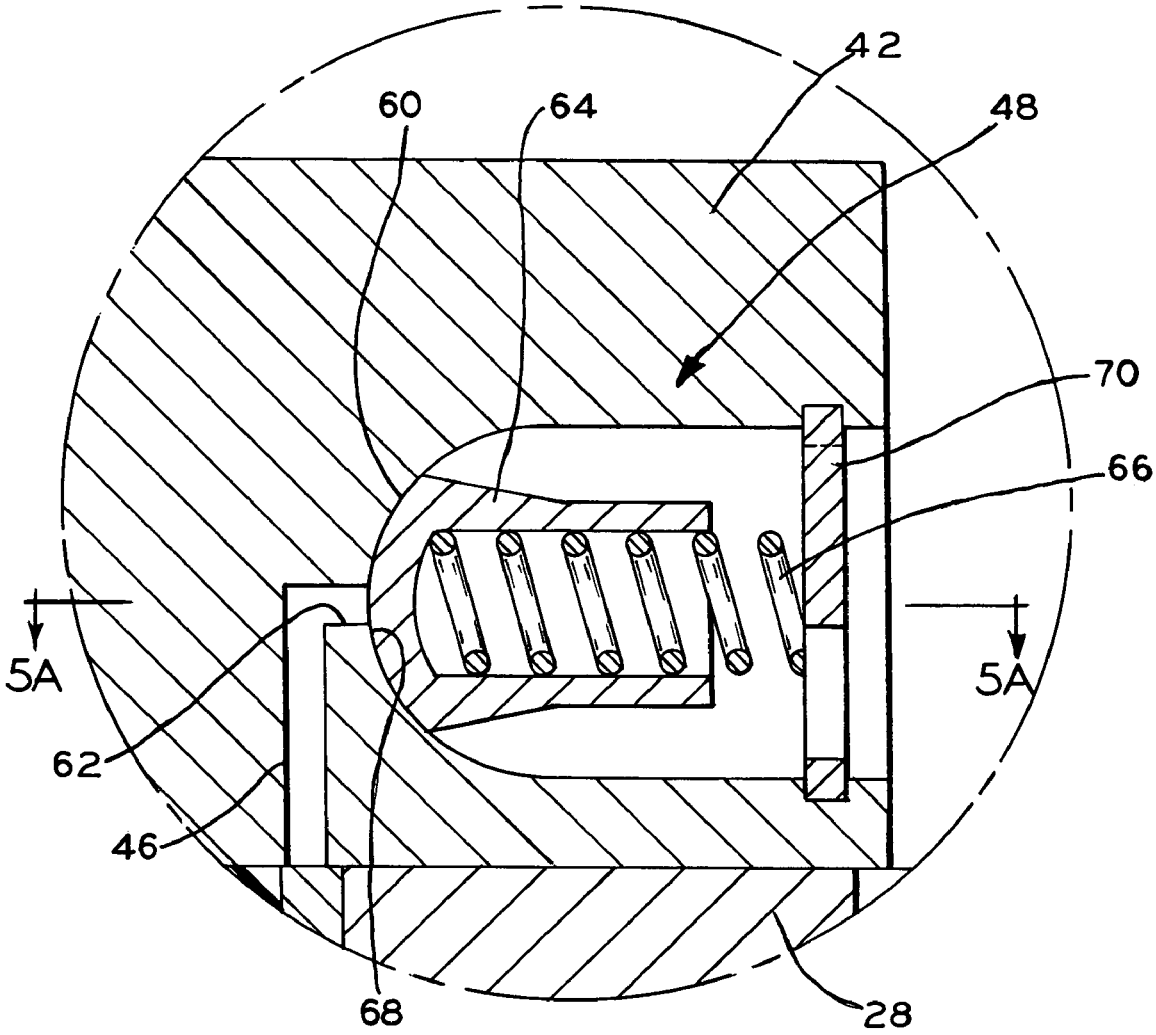
FIG. 1A is a detail view of the discharge valve assembly of the rotary compressor of FIG. 1.
Figure 2:
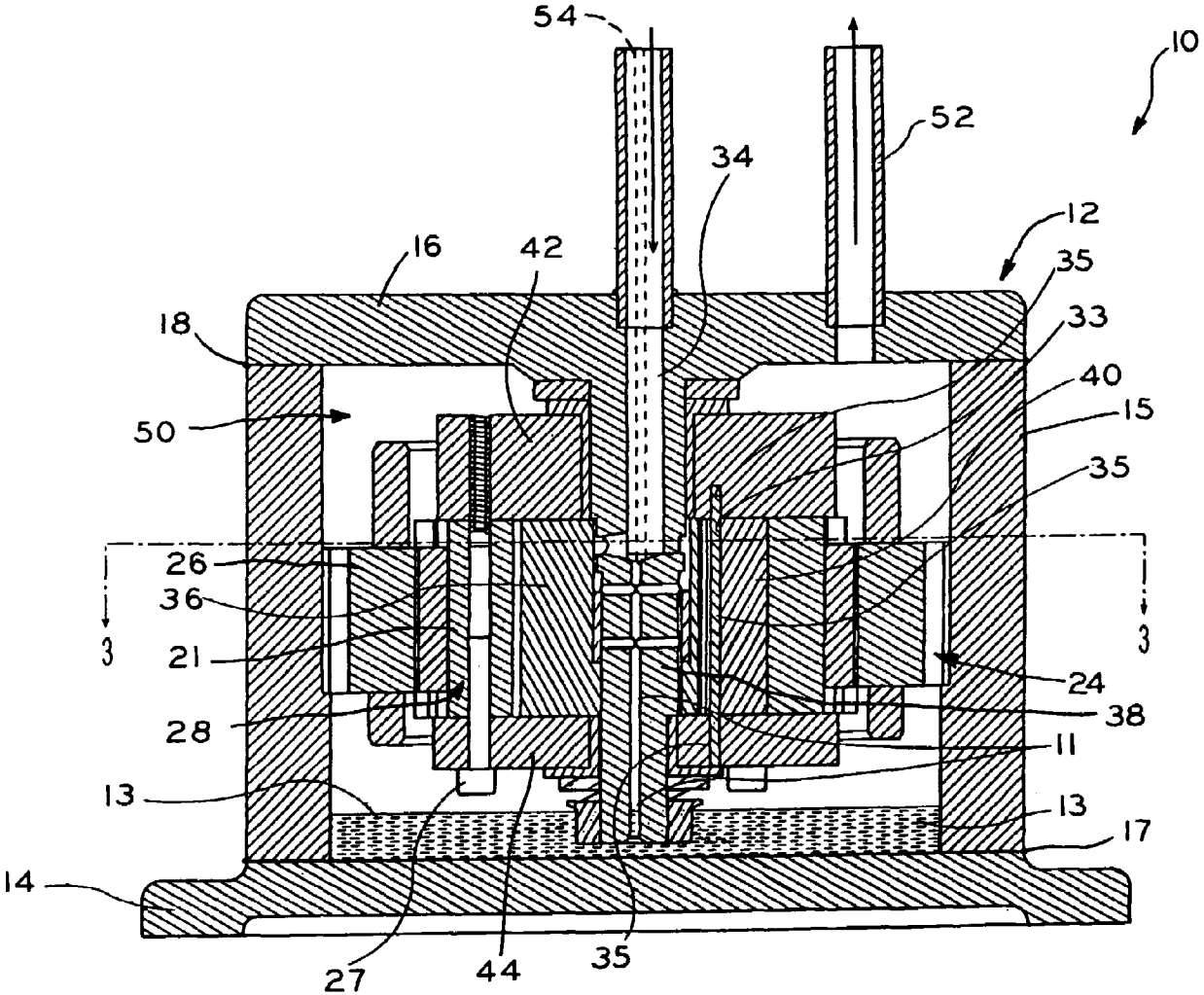
FIG. 2 is an elevational cross-sectional view of the rotary compressor of FIG. 1.
Figure 3:
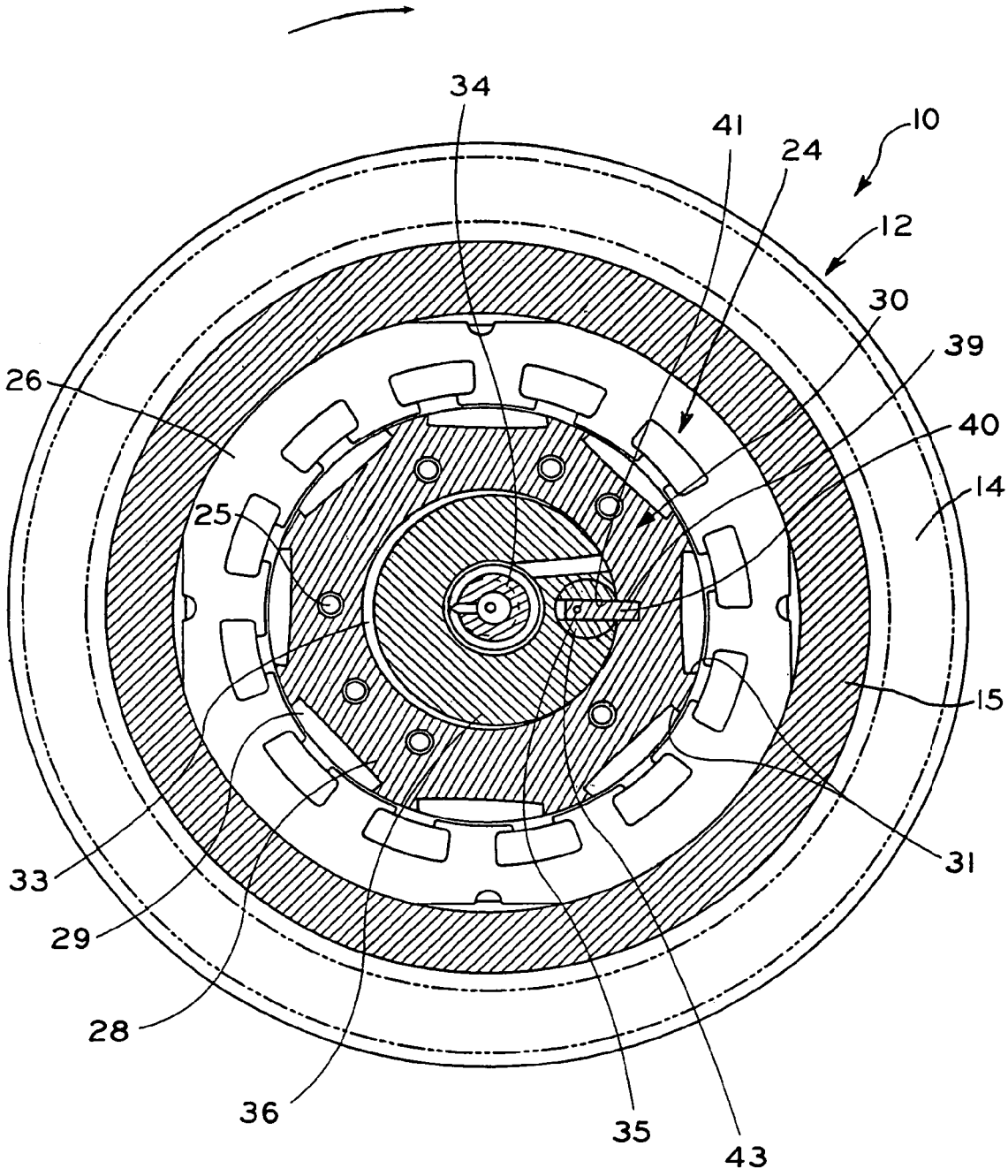
FIG. 3 is a cross-sectional view of the rotary compressor of FIG. 1 taken along line 3-3 in FIG. 2 illustrating a compression mechanism in a first position.
Figure 4:
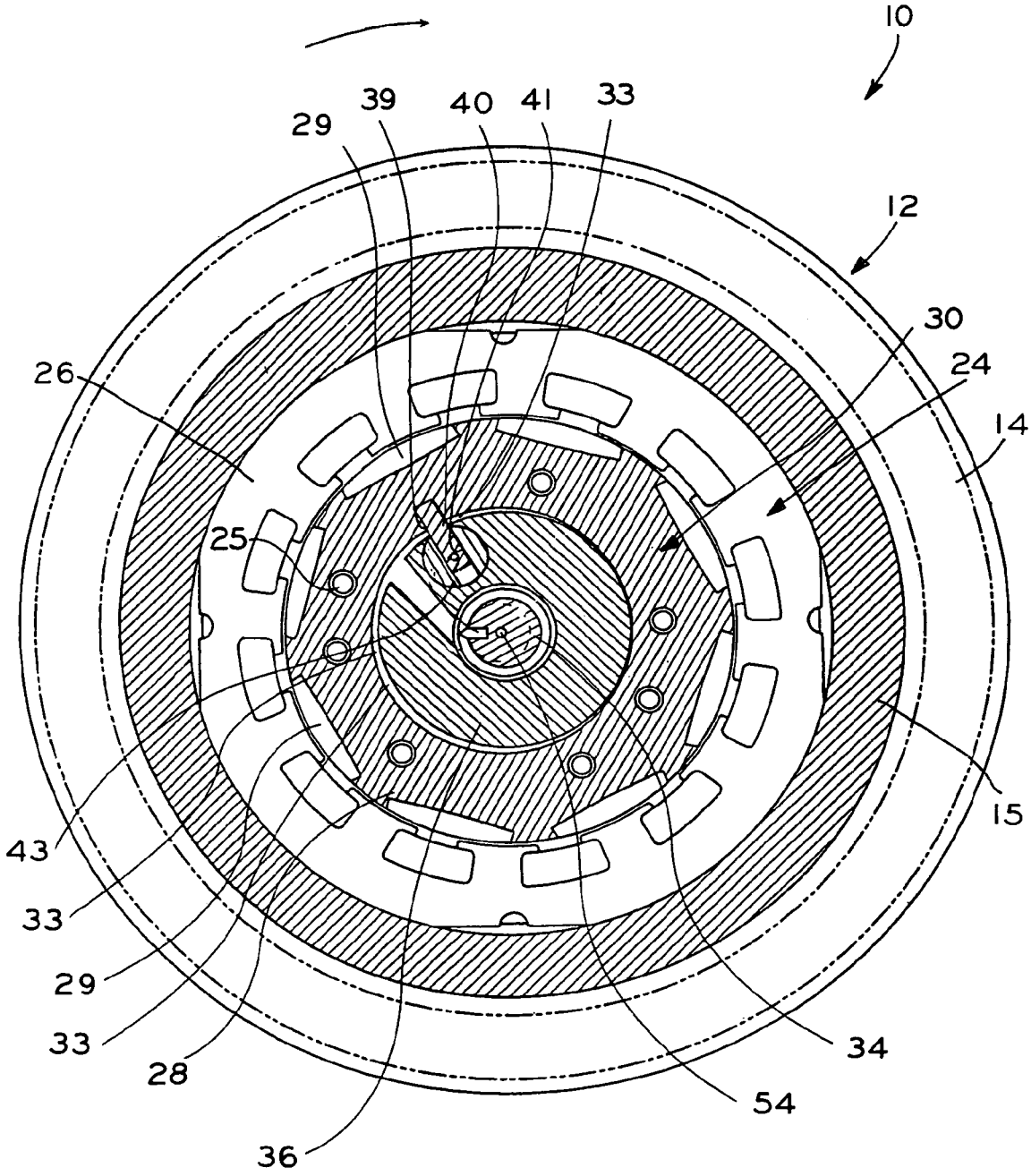
FIG. 4 is a cross-sectional view of the rotary compressor of FIG. 1 similar to FIG. 3 illustrating the compressor mechanism in a second position.

In the embodiment illustrated in FIGS. 1-3, discharge valve 48 includes valve seat 60 surrounding discharge port 62. Discharge port 62 is in fluid communication with the compression chamber via discharge passage 46. Discharge valve 48 includes valve member 64 which has a substantially spherical sealing surface 68 biased into engagement with valve seat 60 by spring 66 to seal discharge port 62. As illustrated in FIG. 1A, spring 66 is compressed between valve member 64 and valve support 70. Valve spring 66 may be a conventional coil spring and may be produced from conventional materials including brass or steel. Although the springs discussed herein are substantially linear springs, which are common in poppet valves, other springs, including non-linear and torsion springs, e.g., may be used in other embodiments.

Figure 5A:
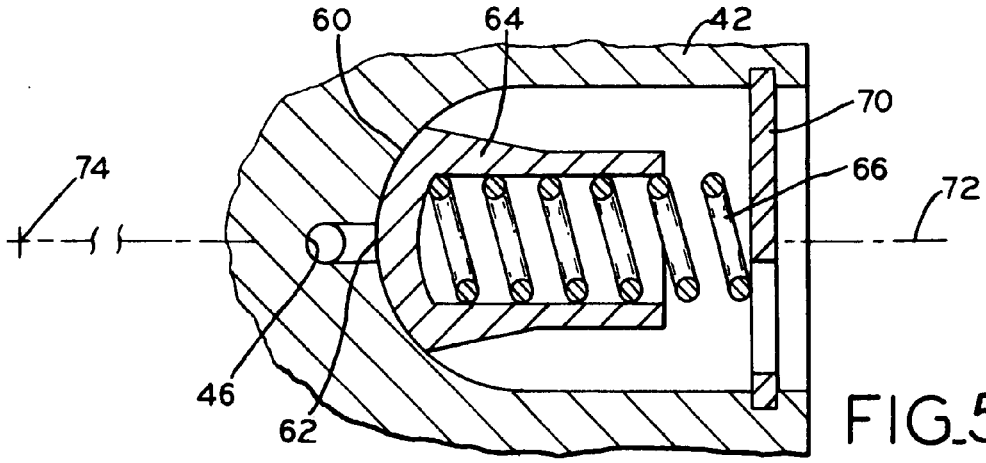
FIG. 5A is a cross-sectional view of the discharge valve assembly of FIG. 1A taken along line 5A-5A in FIG. 1A.
Figure 5B:
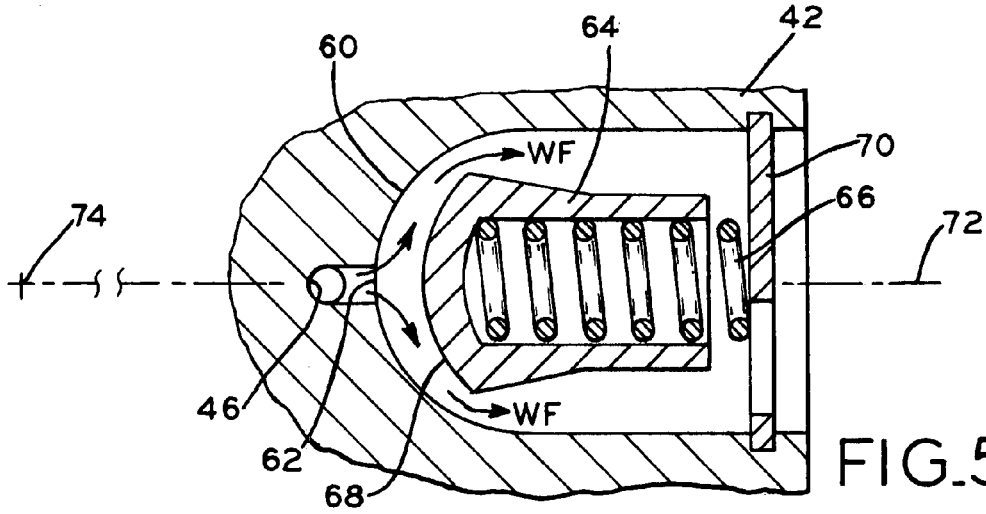
FIG. 5B is a view of the valve head of the discharge valve assembly of FIG. 5A displaced radially from the valve seat.
Figure 5C:
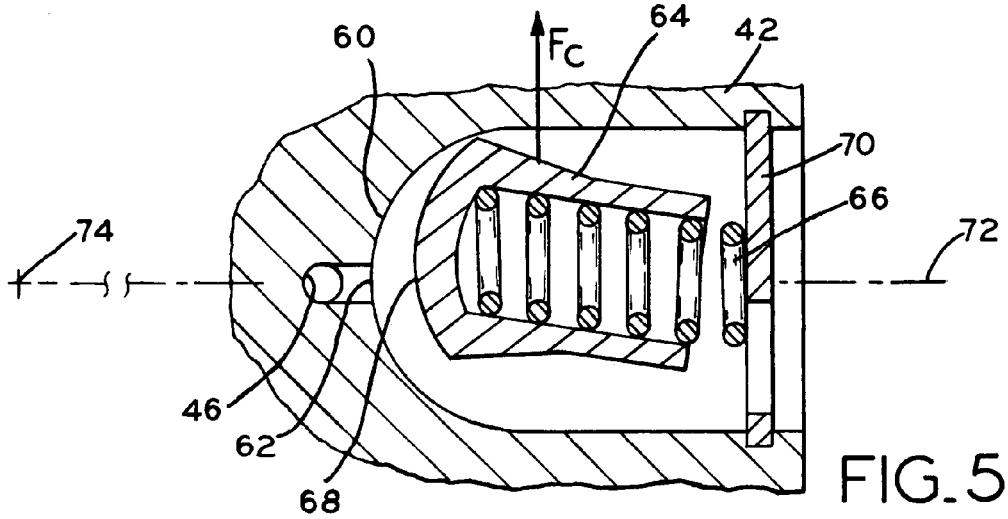
FIG. 5C is a view of the valve head of the discharge valve assembly of FIG. 5A displaced radially and tangentially from the valve seat.

Interior 65 of valve member 64 may be concave or may possess other configurations sufficient to prevent valve member 64 and valve spring 66 from separating from one another. In one embodiment, a retaining ring (not shown) can be used to secure spring 66 within valve member 64. Referring to FIGS. 5A-5C, discharge valve 48 is mounted to the rotor of the compressor such that the axis of spring 66, and the desired axis of displacement of valve member 64, i.e., axis 72, is perpendicular to axis of rotation 74. Axes 72 and 74 define a plane proximate valve member 64 and which is coplanar with the plane of the drawing sheet of FIG. 1 and perpendicular to the drawing sheet of FIGS. 5A-5C.

During the operation of the compressor, the pressure level of the refrigerant, or working fluid, in the compression chamber increases as the rotor is turned by the stator. The pressurized fluid applies a force to valve member 64 tending to lift valve member 64 away from valve seat 60. However, valve member 64 will remain seated against valve seat 60 until the pressure force applied to valve member 64 is sufficient to overcome the spring force biasing valve member 64 against valve seat 60. Once valve member 64 has been lifted away from valve seat 60, a quantity of working fluid, illustrated by arrows WF in FIG. 5B, may escape from the compression chamber. As the working fluid escapes, the pressure level of the working fluid in the compression chamber decreases. As the pressure decreases, the force applied to valve member 64 by the working fluid will be overcome by the spring force of spring 66 such that valve member 64 is re-biased against valve seat 60 by spring 66.

Referring to FIG. 5B, when valve member 64 is displaced, the desired direction of displacement is along a generally radial path, such as displacement axis 72, which is perpendicular to the rotor axis of rotation 74. However, in operation, as valve member 64 is rotated about axis 74, valve member 64 may experience an inertial tangential acceleration, and force, normal to displacement axis 72 when its radial position with respect to axis 74 changes. This tangential force, labeled Fc in FIG. 5C, may displace valve member 64 normally to axis 72 causing valve spring 66 to flex. This tangential displacement may prevent valve member 64 from being properly reseated against valve seat 60. If valve member 64 is not reseated properly against valve seat 60, working fluid may continue to escape through exhaust port 62 and, accordingly, the compressor may not be able to adequately pressurize the fluid.

The inertial tangential force discussed above occurs when valve member 64 is displaced radially as it is seated and unseated from valve seat 60, for example. However, the inertial tangential force may not occur when the radial position of valve member 64 is stationary, such as when valve member 64 is seated against valve seat 60, or when the valve member 64 is held in a constant position displaced away from valve seat 60. In order to prevent valve member 64 from being displaced tangentially by this tangential force, the tangential force must be compensated for while the radial position of valve member 64 is changing.

Figure 6A:
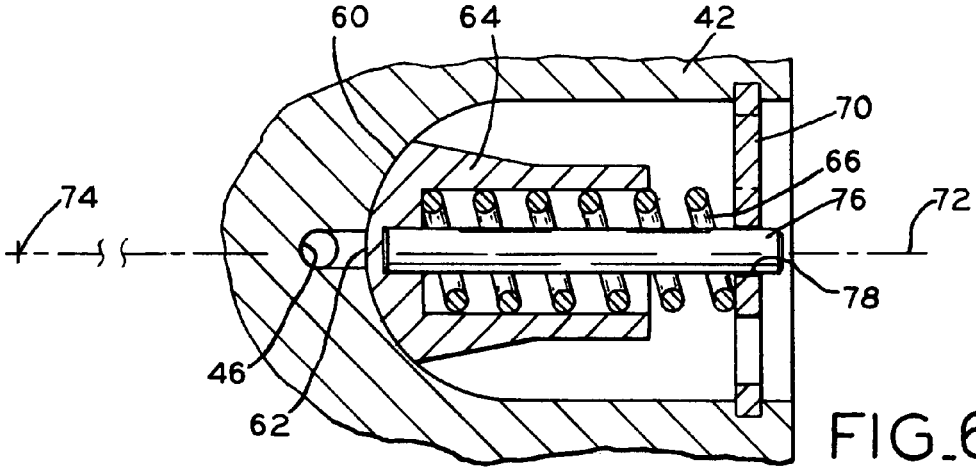
FIG. 6A is a cross-sectional view of a discharge valve assembly having a valve stem affixed to a valve head in accordance with an alternative embodiment of the present invention.
Figure 6B:
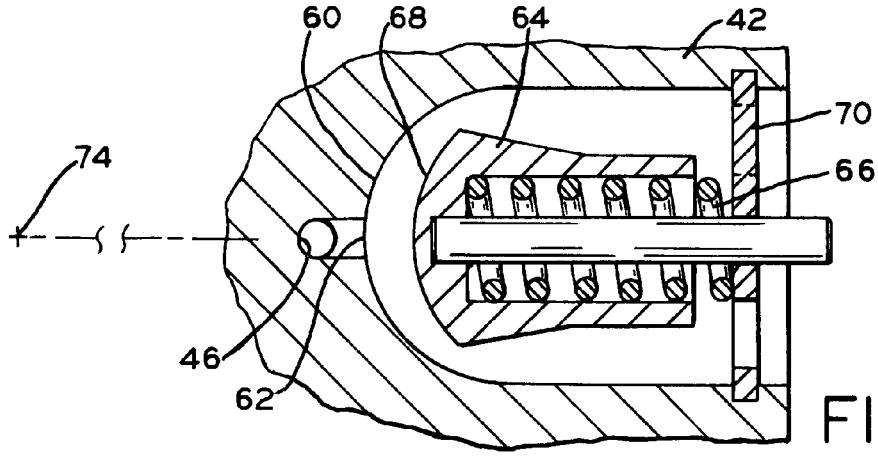
FIG. 6B is a view of the valve head of the discharge valve assembly of FIG. 6A displaced radially from the valve seat.

In one exemplary embodiment, as illustrated in FIGS. 6A and 6B, the tangential force acting on valve member 64 is compensated for by affixing, or rigindly connecting, valve stem 76 to valve member 64. Valve stem 76 passes though valve stem aperture 78 in valve support 70, where valve stem 76, and valve member 64 affixed thereto, are relatively free to translate along radial axis 72. Valve stem 76 is substantially constrained from displaing in a direction tangential to axis 72 by the interaction of, i.e., the closely interfitting relationship between, valve stem 76 and valve stem aperture 78. Thus, as illustrated in FIG. 6B, as valve member 64 is displaced toward or away from valve seat 60, valve member 64. will move substantially along axis 72.

Figure 7:
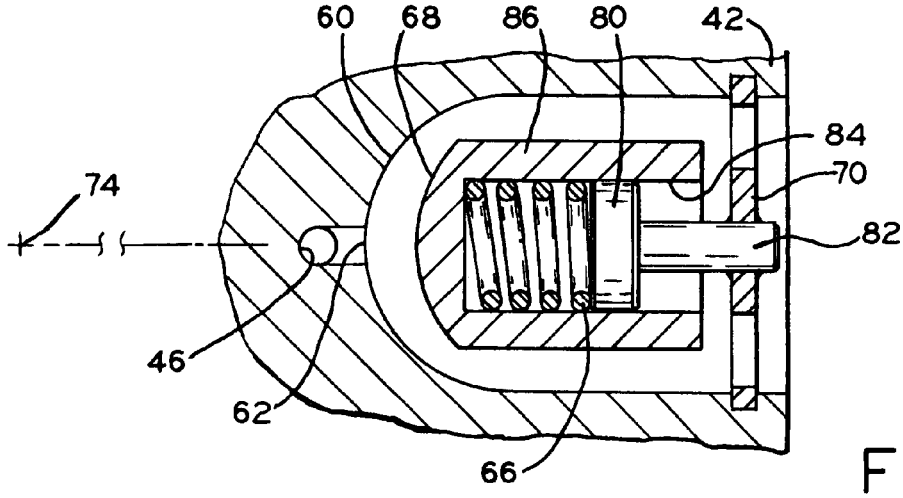
FIG. 7 is a cross-sectional view of a discharge valve assembly having a guide internal to the valve head in accordance with an alternative embodiment of the present invention.

In another embodiment, as illustrated in FIG. 7, valve assembly 48 may include internal guide 80 to limit the displacement of valve member 86. In this embodiment, internal guide 80 is substantially rigid and is affixed to or integral with valve support 82. Internal guide 80 is closely received by interior 84 of valve member 86. Although very little.gap exists between valve member 86 and interior 84, sufficient clearance exists to permit relative motion therebetween. In use, internal guide 80 limits the tangential displacement of valve member 86 when a tangential force is applied to valve member 86, as described above.

Figure 8A:
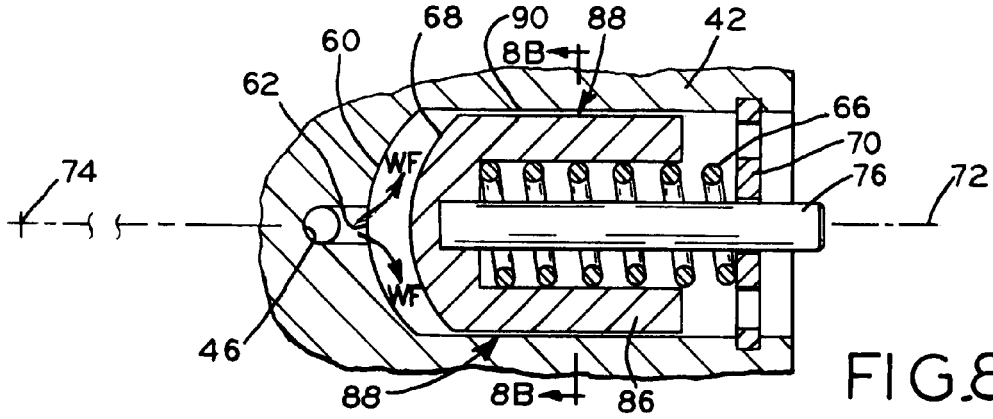
FIG. 8A is a cross-sectional view of a discharge valve assembly having a guide external to the valve head in accordance with an alternative embodiment of the present invention.
Figure 8B:
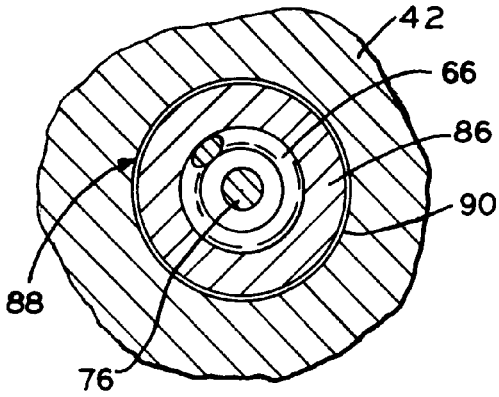
FIG. 8B is a plan view of the discharge valve assembly of FIG. 8A.

In another exemplary embodiment, as illustrated in FIGS. 8A and 8B, the tangential force may be compensated for by an external guide. As illustrated in FIGS. 8A and 8B, gap 88 between surrounding guide wall 90 and valve member 86 is large enough to permit relative radial motion between valve member 86 and guide wall 90, yet small enough to prevent substantial translation of valve member 86 tangential to axis 72. After a small amount of translation, valve member 86 will bear against guide wall 90 preventing further translation.

Figure 9A:
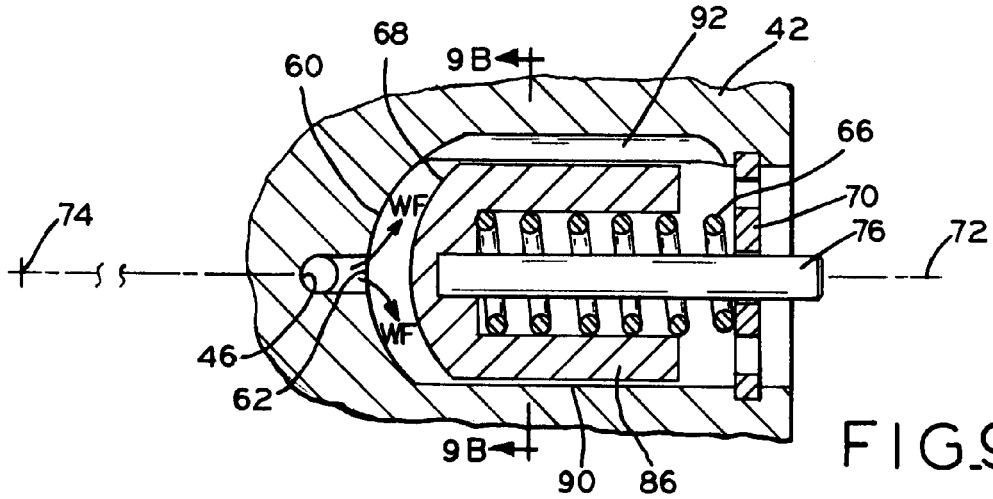
FIG. 9A is a cross-sectional view of a discharge valve assembly having a guide external to the valve head and vent passages to facilitate fluid flow between the valve head and external guide in accordance with an alternative embodiment of the present invention.
Figure 9B:
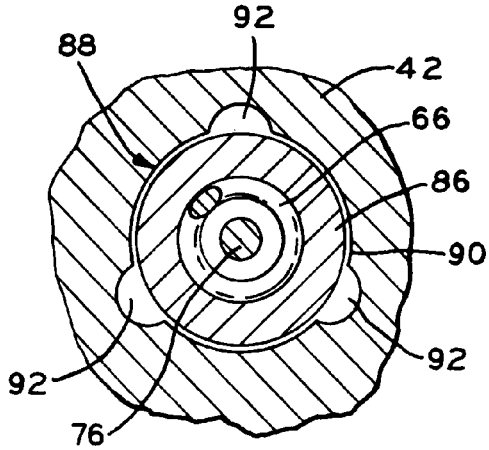
FIG. 9B is a plan view of the discharge valve assembly of FIG. 9A.

In the embodiment illustrated in FIGS. 8A and 8B, gap 88 may be too small to permit working fluid to pass between valve member 86 and guide wall 90. Thus, an alternate path may be provided for the working fluid to flow through. Referring to FIGS. 9A and 9B, vents 92 may be provided around the perimeter of guide wall 90 to permit fluid to pass between valve member 86 and guide wall 90. In the exemplary embodiment illustrated in FIGS. 9A and 9B, three vents 92 are provided. Any number of vents 92 may be provided as long as there remains sufficient bearing surface between guide wall 90 and valve member 86 to prevent valve member 86 from substantially translating in the tangential direction. In other embodiments, apertures (not illustrated) may be provided in the side of valve member 86 to facilitate the flow of working fluid.

Figure 10A:
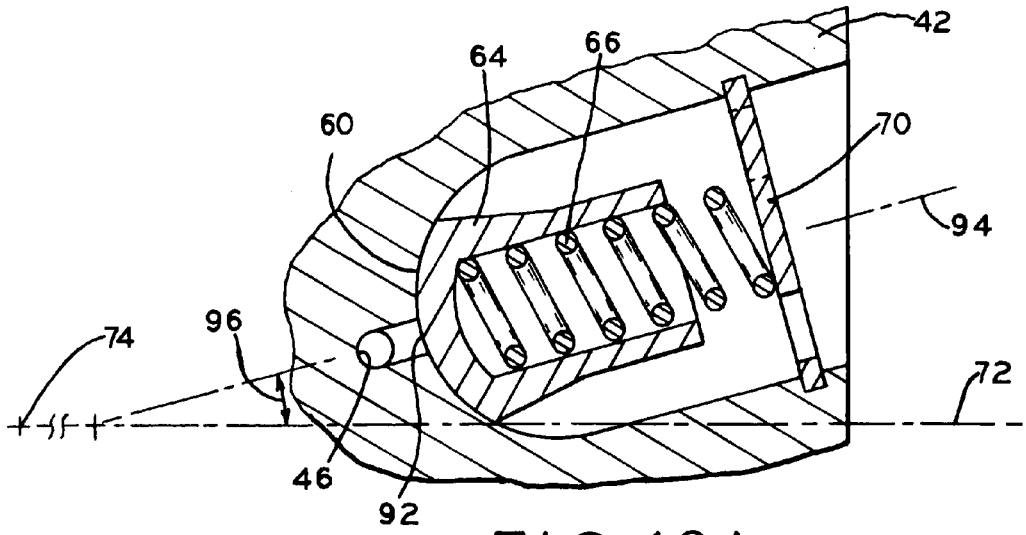
FIG. 10A is a cross-sectional view of a discharge valve assembly having an axis of displacement oblique to a radial axis perpendicular to the axis of rotation of a rotor in accordance with an alternative embodiment of the present invention.
Figure 10B:
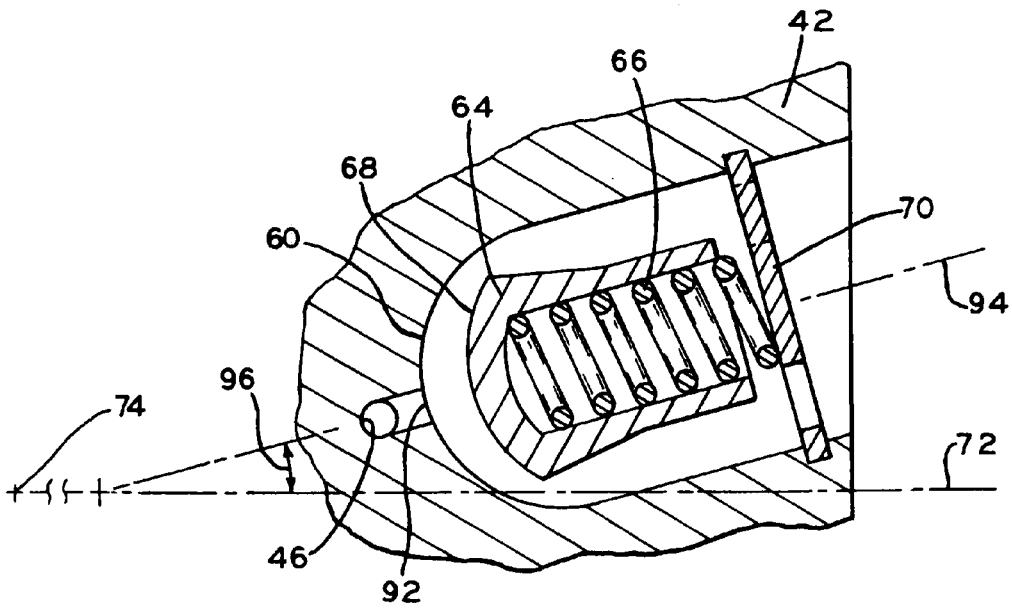
FIG. 10B is a view of the valve head of the discharge valve assembly of FIG. 10A displaced from the valve seat along the oblique axis.

In other embodiments, as illustrated in FIGS. 10A and 10B, valve member 64 may be displaced along a substantially linear path, such as axis 94, without the assistence of a valve stem or guides. Referring to the illustrated embodiment in FIGS. 10A and 10B, axis of displacement 94, which is also the axis of valve spring 66, is oriented at an acute angle with respect to the plane defined by axis of rotation 74 and radial axis 72 such that it is substantially co-linear with the resultant force acting on valve member 64, as discussed in further detail below. In other words, axis 94 lies in a plane perpendicular to the axis of rotation 74 and is canted or aligned obliquely with respect to the axis of rotation 74 so that it does not intersect the axis of rotation 74. As axis 94 and the resultant force are substantially co-linear, valve member 64 is displaced along a substantially straight path.

The resultant force acting on valve member 64 represents the combined force vector acting on valve member 64 which includes the inertial tangential force created from the radial displacement of valve member 64, the centrifugal radial force acting on valve member 64 due to the rotation of the rotor, the pressure force applied on valve member 64 by the working fluid, and the gravitational weight of the valve member 64, among others. Other forces, including gas drag and forces resulting from changes in angular velocity, i.e., rotation speed of the rotor, may also act on the valve member and may also be included in determining the resultant force.

The resultant force is counteracted by spring 66 which resists the movement of valve member 64. The stiffness of spring 66 is selected such that valve member 64 remains seated against valve seat 60 when the pressure of the working fluid in the chamber is below a pre-determined pressure level. However, the stiffness of spring 66 is also selected such that valve member 64 can lift away from valve seat 60 when the pressure level of the working fluid exceeds the pre-determined pressure level.

The angle between displacement axis 94 and the plane defined by axis of rotation 74 and radial axis 72, i.e., angle 96, for any given embodiment will depend upon the magnitude and direction of the forces discussed above. To calculate an appropriate angle 96, the accelerations and forces acting on valve member 64 are summed in three relative directions and are used to solve for the appropriate angle 96. Once angle 96 has been determined, in the present embodiment, valve assembly 48 is oriented such that the axis of coil spring 66 is substantially co-linear with the direction of the resultant force. Stated in another way, valve assembly 48 is canted with respect to the plane defined by axis of rotation 74 and axis 72. In this context, oblique means that axis 94 is neither perpendicular to nor parallel with the plane defined by axis of rotation 74 and axis 72.

Slight variations from the calculated angle 96 may allow valve member 64 to be displaced slightly tangential to axis 96 or displaced along a somewhat curvilinear path. However, these slight variations will not necessarily cause valve member 64 to become grossly, or inoperatively, misaligned with valve seat 60. To account for misalignment between the valve head and valve seat, valve seat 60 or sealing surface 68 of valve member 64 may be beveled, or radiused, e.g., such that valve member 64 is guided into valve seat 60.

As noted above, the inertial tangential force acting on valve member 64, owing to changes in radial position of valve member 64, only occurs when the distance between valve member 64 and the axis of rotation 74 is changing. At all other times, when valve member 64 is not moving radially with respect to the axis of rotation, this inertial tangential force is not acting on valve member 64. In view of this, even though an optimum angle 96 can be. calculated when the inertial tangential force is being applied, consideration for other orientations where the inertial tangential force is not present should be accounted for during the selection of angle 96. In particular, during the above-discussed conditions where the inertial tangential force is not acting on valve member 64, other tangential forces may be acting on valve member 64 owing to, as discussed above, gas drag and changes in rotor speed.

In most circumstances, as the valve moves radially outwardly, the valve head will "lag" behind, or move in the opposite direction of the rotation due to the tangential force discussed above. However, the valve head will "lead", or move in the direction of rotation, when it moves radially inwardly. In other words, the direction of the tangential force acting on the valve head will depend on whether the valve head is being lifted away from or towards the valve seat. Thus, a combination of the improvements discussed above may be necessary to compensate for this phenomena. For example, the valve assembly may be oriented or inclined such that when the valve head is moving outwardly, the valve head moves along axis 94 in response to the resultant force. However, an external or internal guide, as discussed above, may be necessary to oppose the oppositely directed tangential force that occurs when the valve is moving towards the valve seat.

In some embodiments, the angle of valve assembly 48 with respect to the rotor may be adjustable. In these embodiments, angle 96 may be selected from a range of values to align the path of displacement of valve member 64 with the resultant force acting on the valve head. Valve assembly 48 may be held in this selected position by any suitable means, including a ratcheting device, set screw or another suitable fastener. In one embodiment, angle 96 is oriented with respect to the plane defined by axis of rotation 74 and axis 72 at an angle greater than zero degrees but less than or equal to 15 degrees. However, other angles may be preferred in other embodiments. In other embodiments, the axis of displacement may be oriented in any direction that would allow that valve head to be properly seated and unseated from the valve seat.

Orienting the valve assembly in the manners discussed above may provide the added benefit of reducing pressure losses. More particularly, it may be possible to direct the flow of the working fluid exiting the discharge valve away from obstructions which could restrict the flow of the fluid and thus reduce pressure losses. A further advantage of the present embodiment includes aligning contact surface 68 of valve member 64 with valve seat 60 such that the lubricating oil contained in the working fluid exiting the discharge valve is deposited in a substantially even layer on surface 68. A uniform oil film thickness on the valve head is important to control the impact stress distribution across surface 68 as well as reduce the the noise generated when valve head 64 impacts valve seat 60.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rotary compressor, comprising:

a housing;

a motor;

a roller and a vane engaged with said roller;

a rotor positioned within said housing, said rotor driven by said motor and rotatable about an axis of rotation, said rotor engaging said roller and vane to thereby define a compression chamber, said rotor having a discharge port and a valve seat disposed around said discharge port, said discharge port in fluid communication with said compression chamber; and a valve mounted on said rotor, said valve comprising:

a valve head yieldably positioned against said valve seat; and a valve spring, said valve spring yieldably positioning said valve head against said valve seat, said valve spring defining a first axis, said valve head movable along said first axis, wherein said valve head is displaceable from said valve seat to allow compressed fluid within said compression chamber to exit said compression chamber through said discharge port, and wherein said axis of rotation and a radial axis perpendicular to said axis of rotation define a plane, and wherein said valve spring is oriented such that said first axis is oblique with respect to said plane such that said first axis does not intersect said axis of rotation.

2. The compressor of claim 1, wherein said first axis intersects said plane at an angle greater than zero degrees but less than or equal to 15 degrees.

3. A rotary compressor, comprising:

a housing;

a motor;

a roller and a vane engaged with said roller;

a rotor positioned within said housing, said rotor driven by said motor and rotatable about an axis of rotation, said rotor engaging said roller and vane to thereby define a compression chamber, said rotor having a discharge port in fluid communication with said compression chamber;

a valve comprising:

a valve head positioned to cover said discharge port; and a valve spring yieldably positioning said valve head over said discharge port; and means for aligning the movement of said valve head with respect to said valve seat in a direction neither parallel to nor perpendicular and intersecting with said axis of rotation, whereby said valve head is repositioned against said valve seat upon closing.

* * * * *